US011320107B1

(12) United States Patent
Shih

(10) Patent No.: US 11,320,107 B1
(45) Date of Patent: May 3, 2022

(54) VEHICLE LENS APPARATUS

(71) Applicant: T.Y.C. BROTHER INDUSTRIAL CO., LTD., Tainan (TW)

(72) Inventor: Ming-Chih Shih, Tainan (TW)

(73) Assignee: T.Y.C. BROTHER INDUSTRIAL CO., LTD., Tainan (TW)

( * ) Notice: Subject to any disclaimer, the term of this patent is extended or adjusted under 35 U.S.C. 154(b) by 0 days.

(21) Appl. No.: 17/333,529

(22) Filed: May 28, 2021

(51) Int. Cl.
*F21S 41/26* (2018.01)
*F21S 41/265* (2018.01)
*F21W 102/135* (2018.01)

(52) U.S. Cl.
CPC ..... *F21S 41/26* (2018.01); *F21S 41/265* (2018.01); *F21W 2102/135* (2018.01)

(58) Field of Classification Search
CPC ..... F21S 41/25; F21S 41/255; F21S 41/26; F21S 41/265; F21S 41/27; F21S 41/275; F21W 2102/135
See application file for complete search history.

(56) References Cited

U.S. PATENT DOCUMENTS

2020/0318804 A1* 10/2020 Brunne ..... F21S 41/285

* cited by examiner

*Primary Examiner* — Robert J May
(74) *Attorney, Agent, or Firm* — Muncy, Geissler, Olds & Lowe, P.C.

(57) ABSTRACT

A vehicle lens apparatus includes a top lens connected to a main lens. The main lens projects onto a horizontal surface a first light pattern with a width in a rear-to-front direction to include a first main light region, and two first lateral light regions respectively formed at left and right sides of the first main light region. The top lens projects a second light pattern convexed in a rear-to-front direction, and includes a second main light region superimposed on the first main light region, and two second lateral light regions respectively and rearwardly extending from left and right sides of the second main light region to protrude rearwardly from the first lateral light regions.

19 Claims, 12 Drawing Sheets

VEHICLE LENS APPARATUS

FIELD

The disclosure relates to a lens apparatus, and more particularly to a vehicle lens apparatus.

BACKGROUND

FIGS. 1 and 2 illustrate an existing vehicle lens apparatus 11 that includes a plurality of lens 12 integrally connected to and juxtaposed with each other in a right-left direction. Each lens 12 is convexed in a rear-to-front direction and has a light entry face 121 and a light exit face 122. The lenses 12 cooperate with each other to project light and generate a light distribution pattern on a road 13 as shown in FIG. 2. The light from, the lenses 12 can illuminate a main region 131 of the road 13 in front of the lenses 12 and left and right regions 14 at two sides of the main region 131. However, the lenses 12 are unable to project light to left and right rear areas 12 behind the left and right regions 14. Therefore, dark areas 15 are easily formed behind the left and right regions 14 and are likely to cause danger.

SUMMARY

Therefore, an object of the disclosure is to provide a vehicle lens apparatus that can alleviate at least one of the drawbacks of the prior art.

According to the disclosure, a vehicle lens apparatus, suitable for projecting light rays of a light source on a horizontal surface, includes at least one lens unit that has a main lens and a top lens connected to a top end of the main lens.

The main lens includes a main light exit face and a main light entry face formed rearwardly of the main light exit face. The main lens is configured to project in a rear-to-front direction from the light source onto the horizontal surface a first light pattern having a length extending in a left-right direction and a width extending in the rear-to-front direction. The first light pattern includes a first main light region, and two first lateral light regions respectively formed at left and right sides of the first main light region.

The top lens is configured to project onto the horizontal surface a second light pattern that is convexed in the rear-to-front direction. The second light pattern includes a second main light region superimposed on the first main light region, and two second lateral light regions extending respectively and rearwardly from left and right sides of the second main light region. The second lateral light regions protrude rearwardly and respectively from the first lateral light regions.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
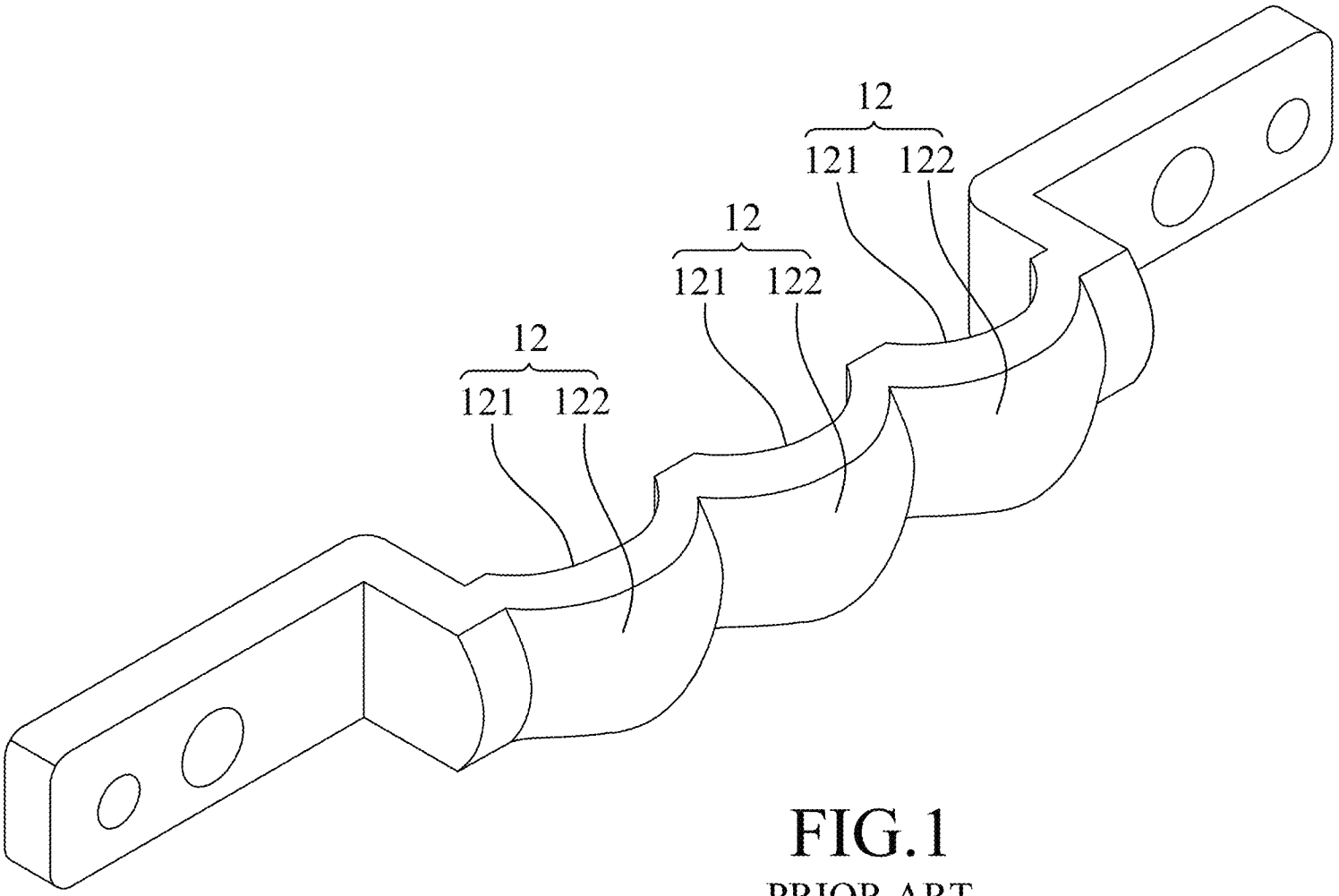
FIG.1 PRIOR ART
FIG. 1 is a perspective view of an existing vehicle lens apparatus.
Figure 2:
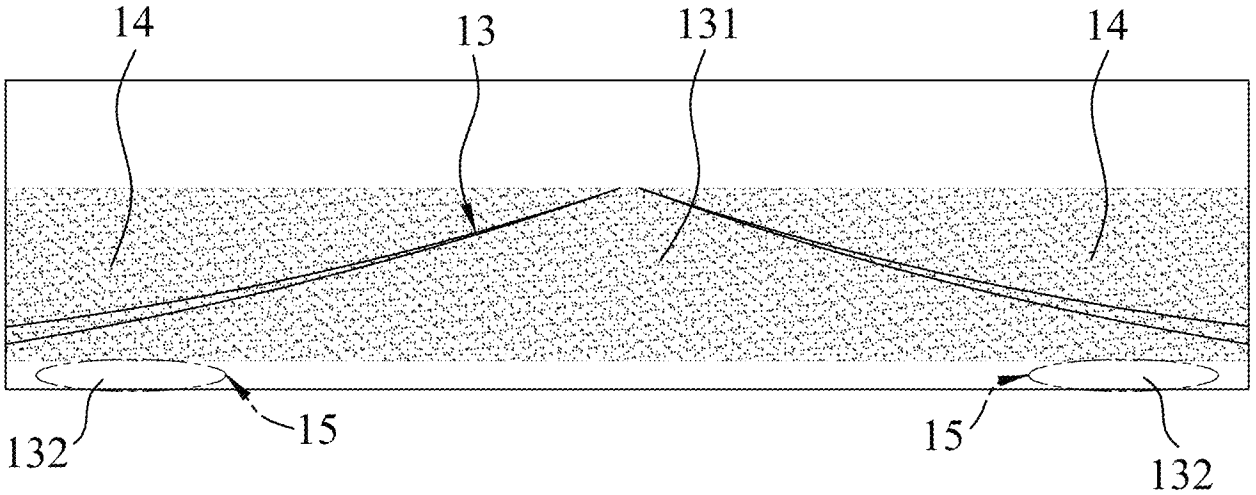
FIG.2 PRIOR ART
FIG. 2 illustrates a stimulated light pattern of the existing vehicle lens.
Figure 3:
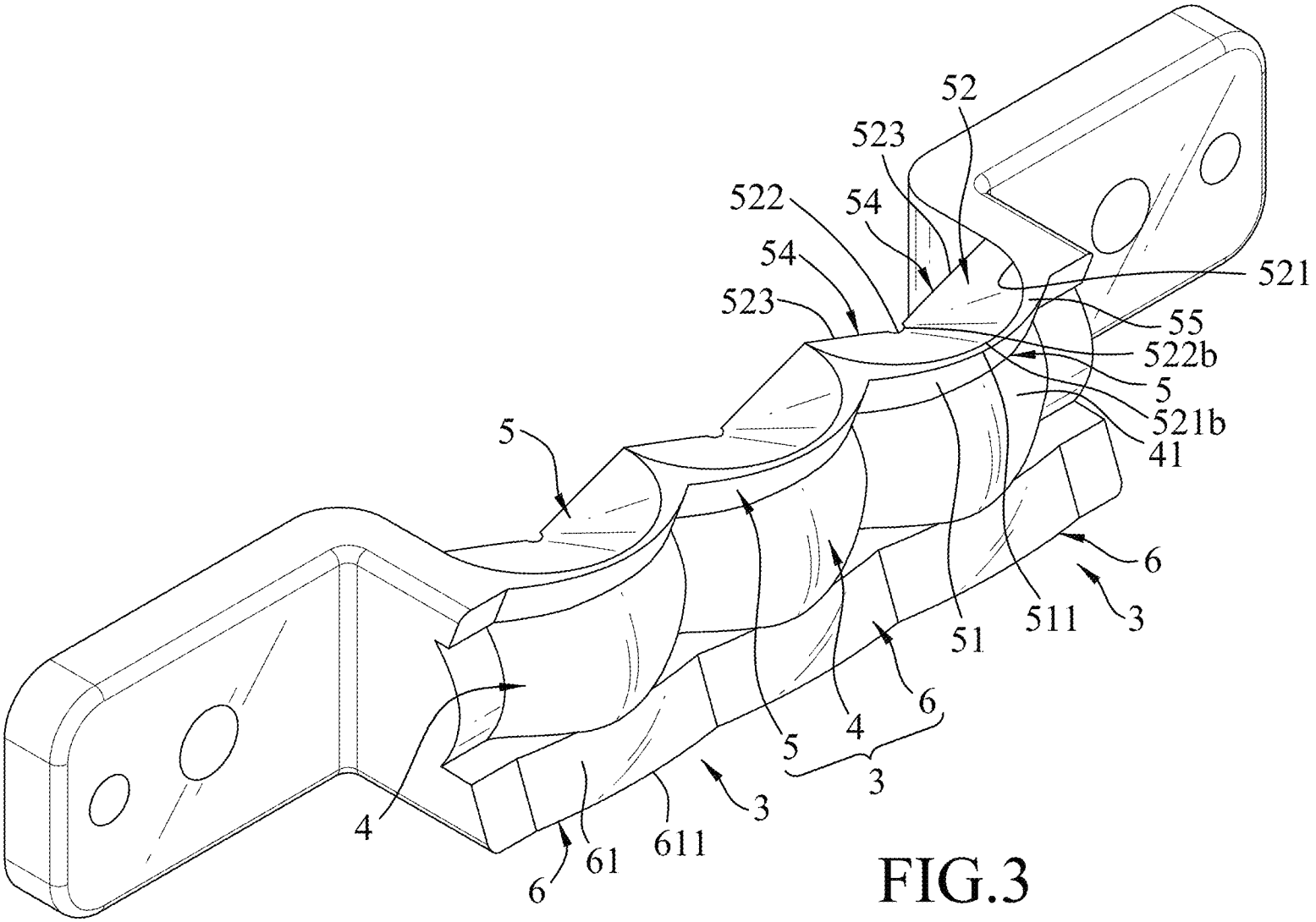
FIG. 3 is a top perspective view illustrating a vehicle lens apparatus according to an embodiment of the disclosure.
Figure 4:
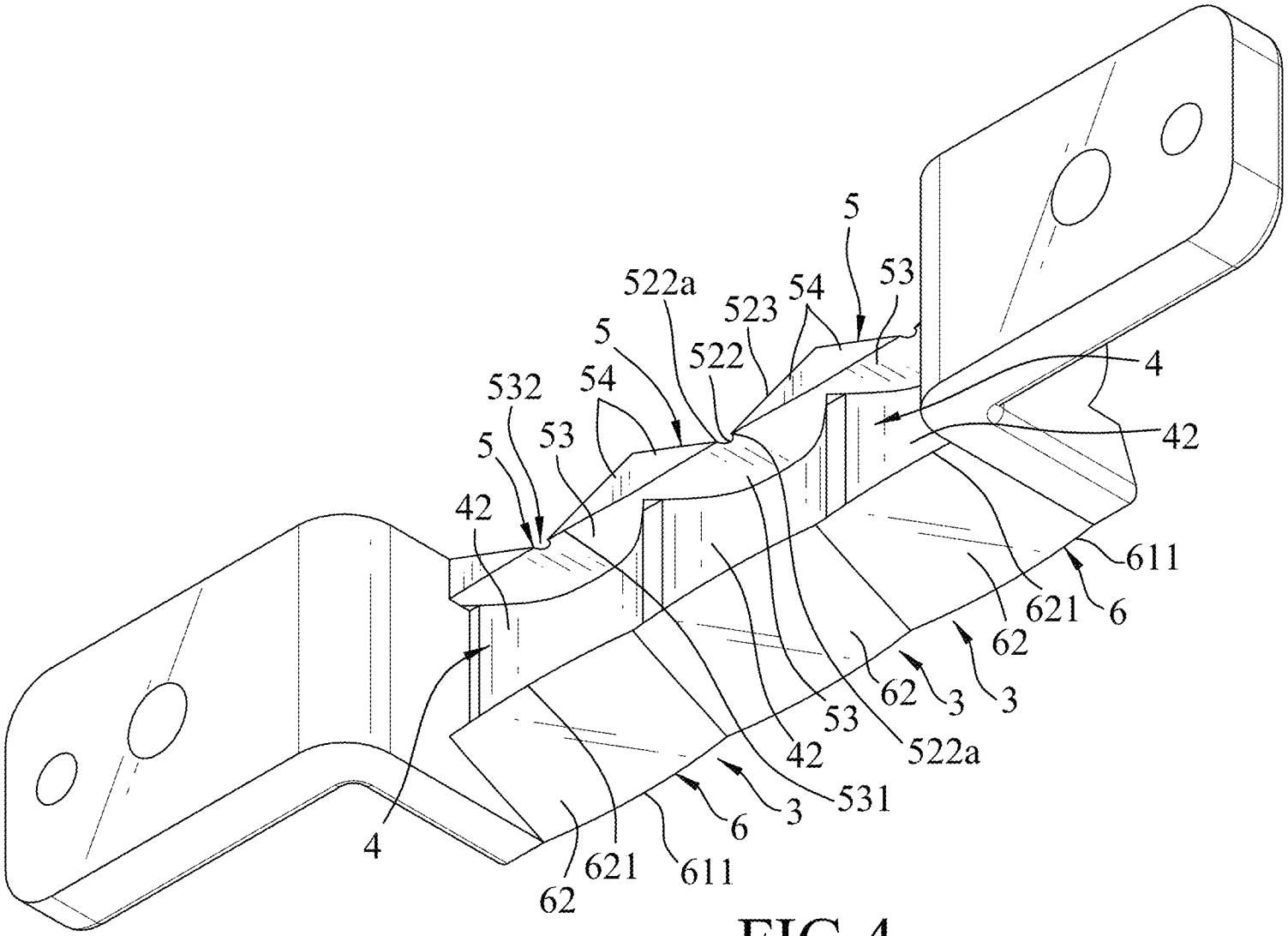
FIG. 4 is a bottom perspective view of the embodiment.
Figure 5:
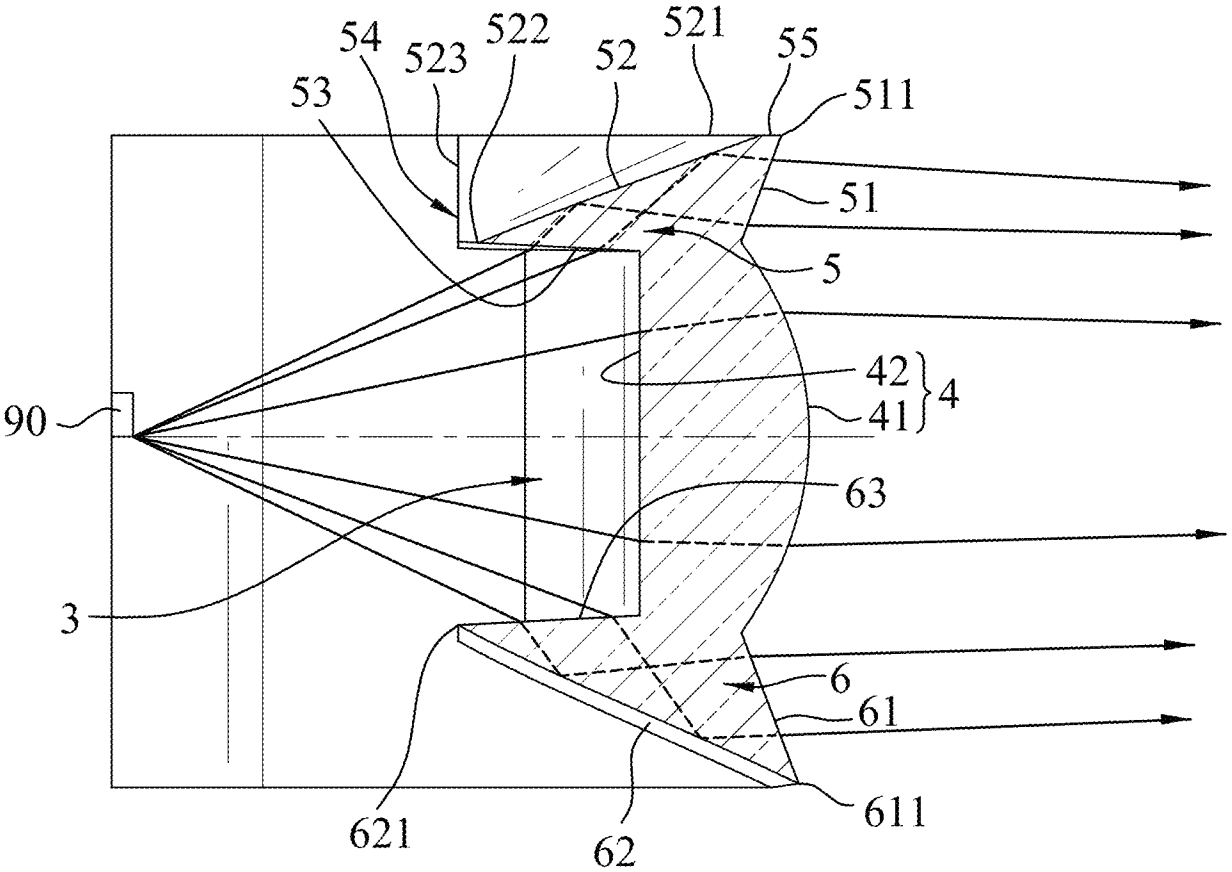
FIG. 5 is a sectioned side view of the embodiment.

FIGS. 3 to 5 illustrate a vehicle lens apparatus according to an embodiment of the disclosure. The vehicle lens apparatus of the disclosure is suitable for projecting light rays of a light source 90 on a horizontal surface 91 (see FIG. 10), and includes a plurality of lens units 3 juxtaposed with each other in a left-right direction and integrally connected to each other.

In this embodiment, each lens unit 3 is made of a transparent acrylic material. Each lens unit 3 includes a main lens 4, a top lens 5 integrally connected to a top end of the main lens 4, and a bottom lens 6 integrally connected to a bottom end of the main lens 4.

The main lens 4 includes a main light exit face 41 and a main light entry face 42 formed rearwardly of and spaced apart from the main light exit face 41. The main light exit face 41 in either horizontal or vertical cross section is convexed in a rear-to-front direction. The main light entry face 42 in horizontal cross section is convexed in the rear-to-front direction, and in vertical cross section is straight in a top-bottom direction.

Figure 6:
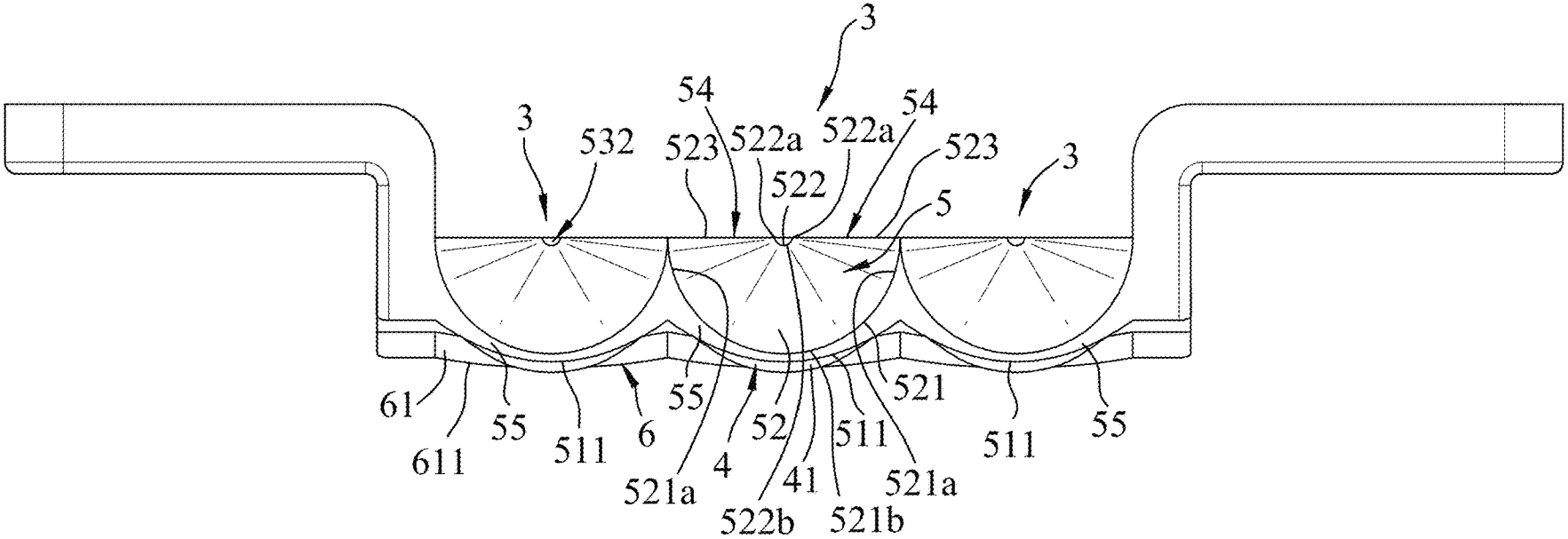
FIG. 6 is a top view of the embodiment.
Figure 7:
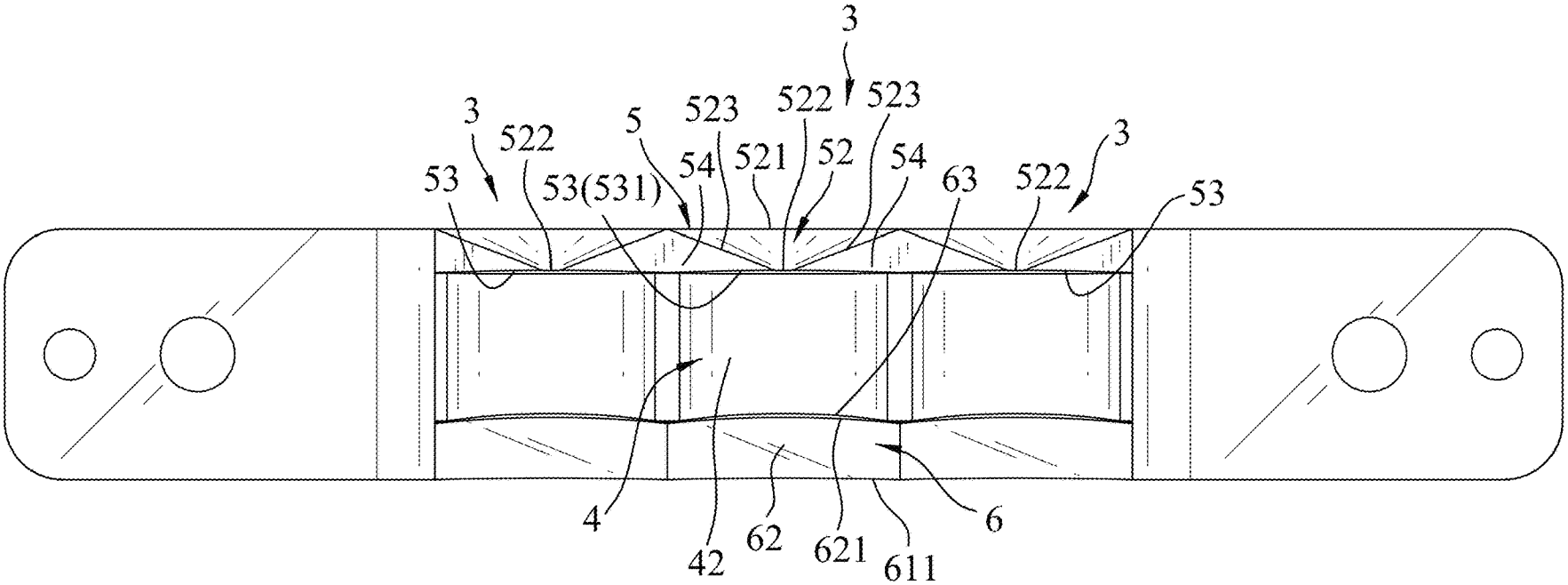
FIG. 7 is a rear view of the embodiment.

Referring to FIGS. 6 and 7 in combination with FIGS. 3 to 5, the top lens 5 has a top lens front face 51, a top lens rear face 52, a top lens bottom face 53, two end faces 54, and a connection face 55.

The top lens front face 51 is connected to an upper end of the main light exit face 41 for exiting light. The top lens front face 51 includes a top lens upper edge 511 distal from the main light exit face 41. A cross section of the top lens front face 51, which is formed along a horizontal cutting plane, has the shape of a parabolic curve that is convexed forwardly. Therefore, the top lens upper edge 511 is also the form of a parabolic curve convexed forwardly.

The top lens rear face 52 is a total internal reflection surface formed rearwardly of the top lens front face 51 for reflecting light to the top lens front face 51. The top lens rear face 52 includes an upper curve edge 521, a lower curve edge 522, and two rear edges 523. The upper curve edge 521 has two spaced apart rear ends 521*a* and is convexed forwardly from the rear ends 521*a*. The lower curve edge 522 has two spaced apart rear ends 522*a* lower than the rear ends 521*a* of the upper curve edge 521 and convexed forwardly from the two spaced apart rear ends 521*a* of the lower curve edge 521. A front side 522*b* of the lower curve edge 522 is situated behind and below a front side 521*b* of the upper curve edge 521. The top lens rear face 52 extends divergingly and upwardly from the lower curve edge 522 to the upper curve edge 521. The rear edges 523 extend upwardly, divergingly and respectively from the two spaced apart rear ends 522*a* of the lower curve edge 522 and are connected respectively to the rear ends 521*a* of the upper curve edge 521. As shown in FIG. 3, the top lens rear face 52 resembles a halved section of truncated conical surface that is concaved downwardly toward the top lens bottom face 53 (details thereof are described hereinafter).

As shown in FIGS. 4 and 5, the top lens bottom face 53 is a semicircular refraction surface for entry of light and has a bottom face rear edge 531. The top lens bottom face 53 is connected to an upper end of the main light entry face 42 and extends rearwardly below the top lens rear face 52 from the upper end of the main light entry face 42 to the bottom face rear edge 531. The bottom face rear edge 531 has a notch 532. The lower curve edge 522 of the top lens rear face 52 is formed at the notch 532 as a boundary of the notch 532. The two spaced apart rear ends 522*a* of the lower curve edge 522 meet the bottom face rear edge 531. As shown in FIG. 5, the light rays of a light source 90 are refracted by the top lens bottom face 53 to the top lens rear face 52, reflected by the top lens rear face 52 to the top lens front face 51, and then projected outwardly through the top lens front face 51.

The two end faces 54 are spaced apart from each other in the left-right direction. Each end face 54 is an upright surface connected between one of the rear edges 523 of the top lens rear face 52 and the bottom face rear edge 531 of the top lens bottom face 53. The upper curve edge 521 is semicircular, and the rear ends 521*a* of the upper curve edge 521 are respectively connected to upper ends of the rear edges 523 or the end faces 54. The lower curve edge 522 is semicircular, and lower ends of the ends faces 54 are respectively connected to the rear ends 522*a* of the lower curve edge 522.

As shown in FIG. 3, the connection face 55 are connected between the top lens upper edge 511 of the top lens front face 51 and the front side 521*b* of the top lens rear face 52.

Figure 8:
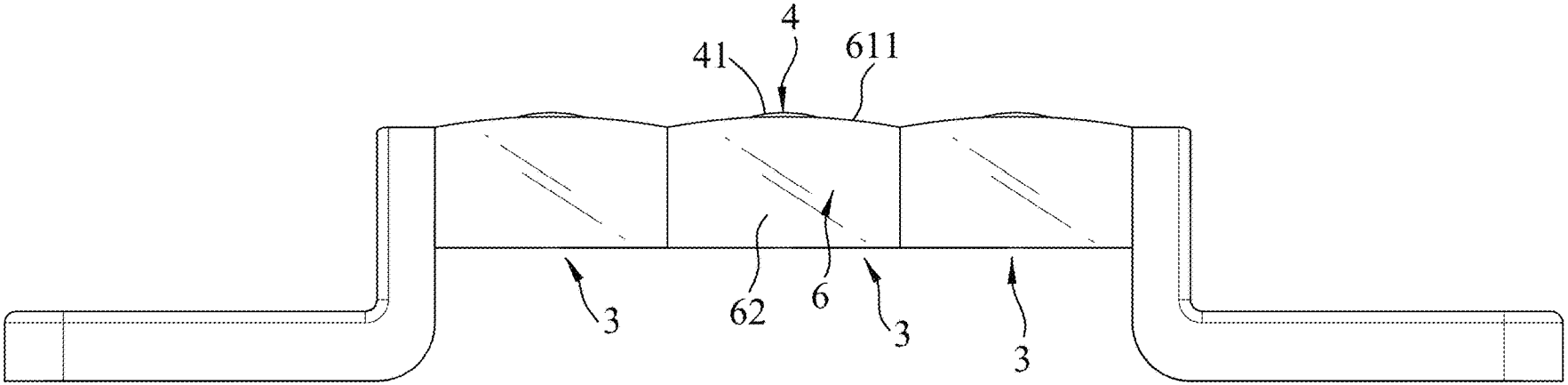
FIG. 8 is a bottom view of the embodiment.

Referring to FIGS. 4, 7 and 8, the bottom lens 6 is connected to a bottom end of the main lens 4, and includes a bottom lens front face 61, a bottom lens rear face 62, and a bottom lens top face 63.

The bottom lens front face 61 is connected to a lower end of the main light exit face 41 for exiting light. The bottom lens front face 61 has a cross section formed along a horizontal cutting plane and resembles a parabolic curve that is convexed forwardly. Further, the bottom lens front face 61 includes a bottom lens front edge 611 distal from the lower end of the main light exit face 41 of the main lens 4. The bottom lens front edge 611 is the form of a parabolic curve convexed forwardly.

The bottom lens rear face 62 is a total internal reflection surface formed rearwardly of the bottom lens front face 61 for reflecting light to the bottom lens front face 61. The bottom lens rear face 62 has a cross section that is formed along a horizontal cutting plane and that resembles a concave curve concaved upwardly. The bottom lens rear face 62 has a bottom lens rear edge 621. The bottom lens rear face 62 extends rearwardly and upwardly from the bottom lens front edge 611 to the bottom lens rear edge 621. The bottom lens rear edge 621 is the form of a parabolically concave curve concaved upwardly.

The bottom lens top face 63 is a refraction surface for entry of light and is connected to a lower end of the main light entry face 41 and extends rearwardly above the bottom lens rear face 62. The bottom lens rear face 62 is concaved upwardly toward the bottom lens top face 63. The bottom lens rear edge 621 of the bottom lens rear face 62 is connected to a rear end of the bottom lens top face 63. The light from the light source 90 is refracted by the bottom lens top face 63 to the bottom lens rear face 62, reflected by the bottom lens rear face 62 to the bottom lens front face 61, and projected through the bottom lens front face 61.

FIGS. 9, 11, 13, and 15 illustrate simulated light patterns projected by the vehicle lens apparatus of the disclosure on a vertical plane placed 10 meters therefrom. FIGS. 10, 12, 14, and 16 illustrate stimulated light patterns projected on the horizontal surface 91 in front of the vehicle lens apparatus and on a road 92.

Figure 9:
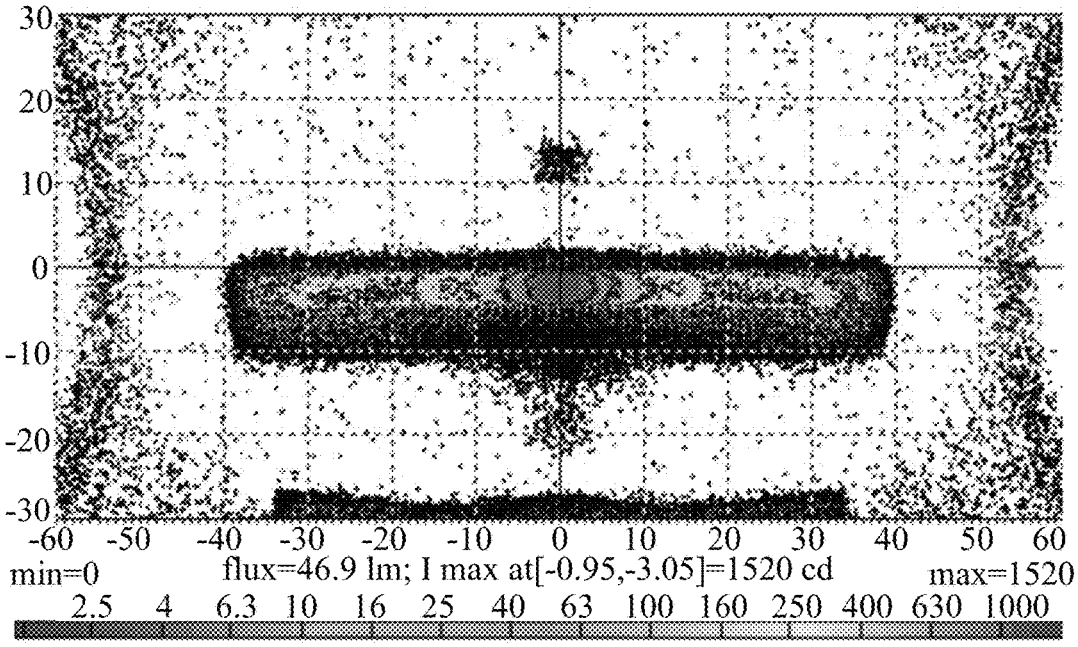
FIG. 9 is a simulated light distribution graph formed on a vertical surface by a main lens of the vehicle lens apparatus of the embodiment.
Figure 10:
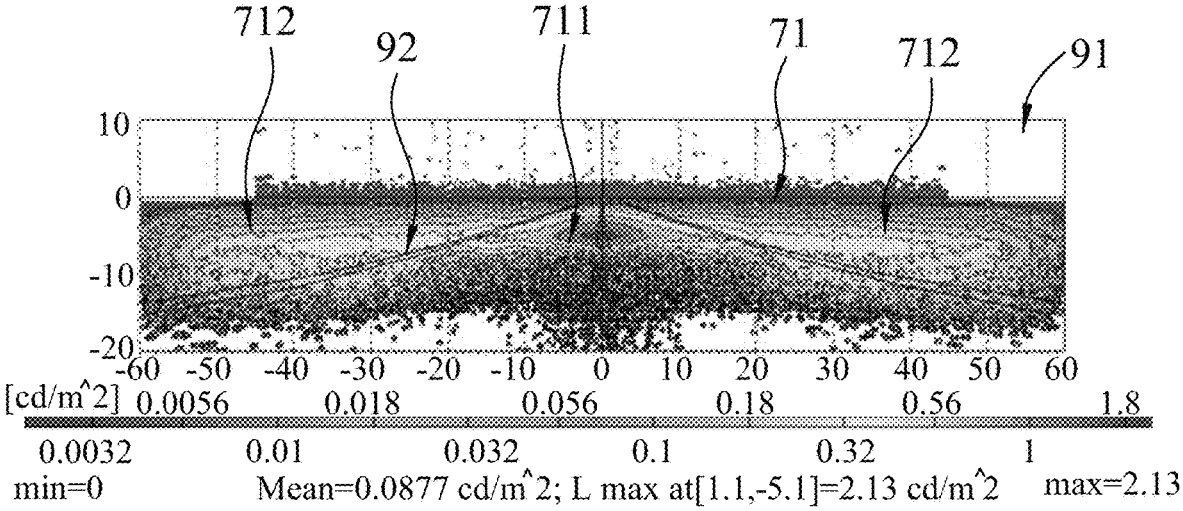
FIG. 10 is a simulated light distribution graph formed on a horizontal surface by the main lens.

Referring to FIGS. 5, 9 and 10, the main lens 4 projects in the rear-to-front direction from the light source 90 onto the horizontal surface 91 a first light pattern 71 with a length extending in the left-right direction and a width extending in the rear-to-front direction. As shown in FIG. 10, the first light pattern 71 in a rectangular form includes a first main light region 711 centrally covering the road 92, and two first lateral light regions 712 respectively formed at left and right sides of said first main light region 711.

Figure 11:
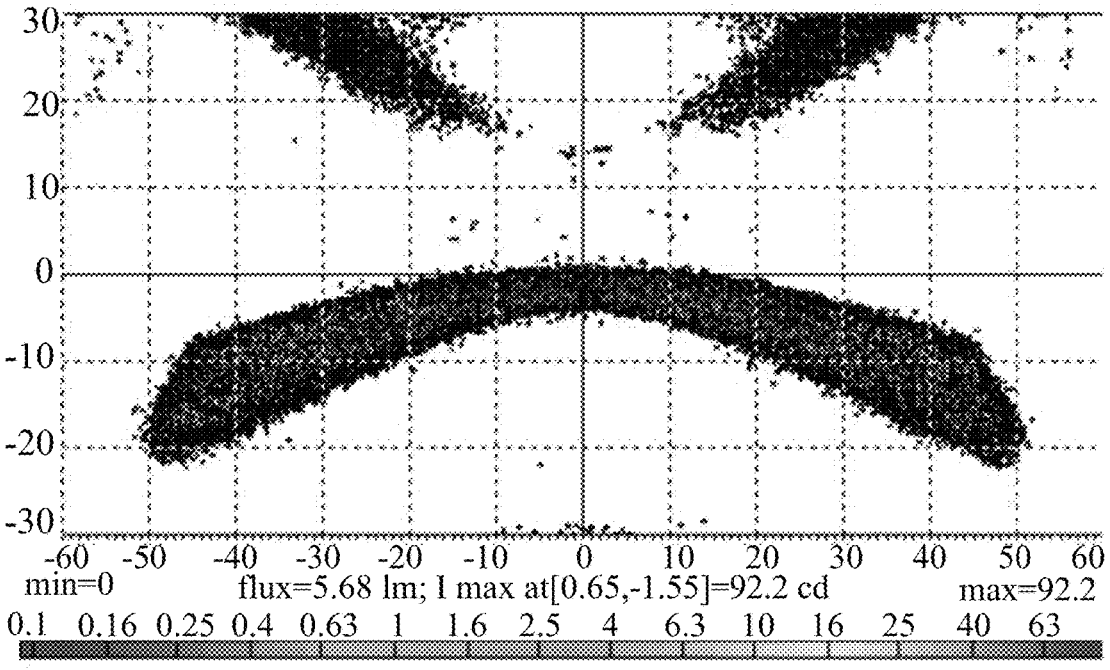
FIG. 11 is a simulated light distribution graph formed on a vertical surface by a top lens of the vehicle lens apparatus of the embodiment.
Figure 12:
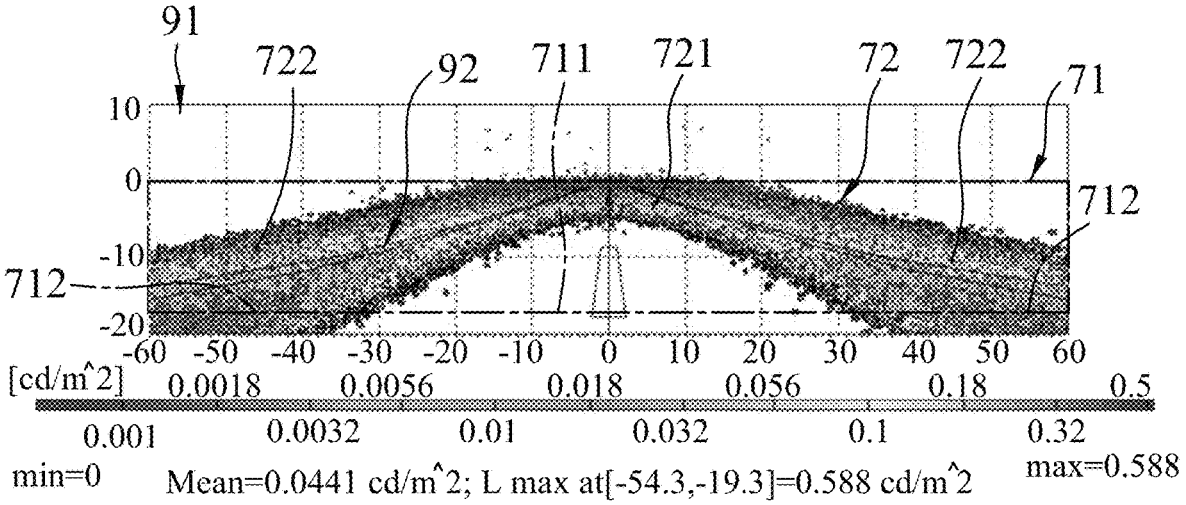
FIG. 12 is a simulated light distribution graph formed on a horizontal surface by the top lens.

FIGS. 11 and 12 illustrate light patterns generated by the top lens 5. A phantom area defined by phantom lines in FIG. 12 schematically represents a region covered by the first light pattern 71.

As shown in FIG. 12, the top lens 5 projects onto the horizontal surface 91 a second light pattern 72 that is convexed in the rear-to-front direction. The second light pattern 72 includes a second main light region 721 superimposed on the first main light region 711, and two second lateral light regions 722 extending respectively and rearwardly from left and right sides of the second main light region 721. A width of the second main light region 721 in the rear-to-front direction is smaller than that of the first main light region 711, and does not protrude from the first main light region 711. The second lateral light regions 722 protrude rearwardly and respectively from the first lateral light regions 712, and also protrude respectively and sidewardly from left and right sides of the road 92.

Figure 13:
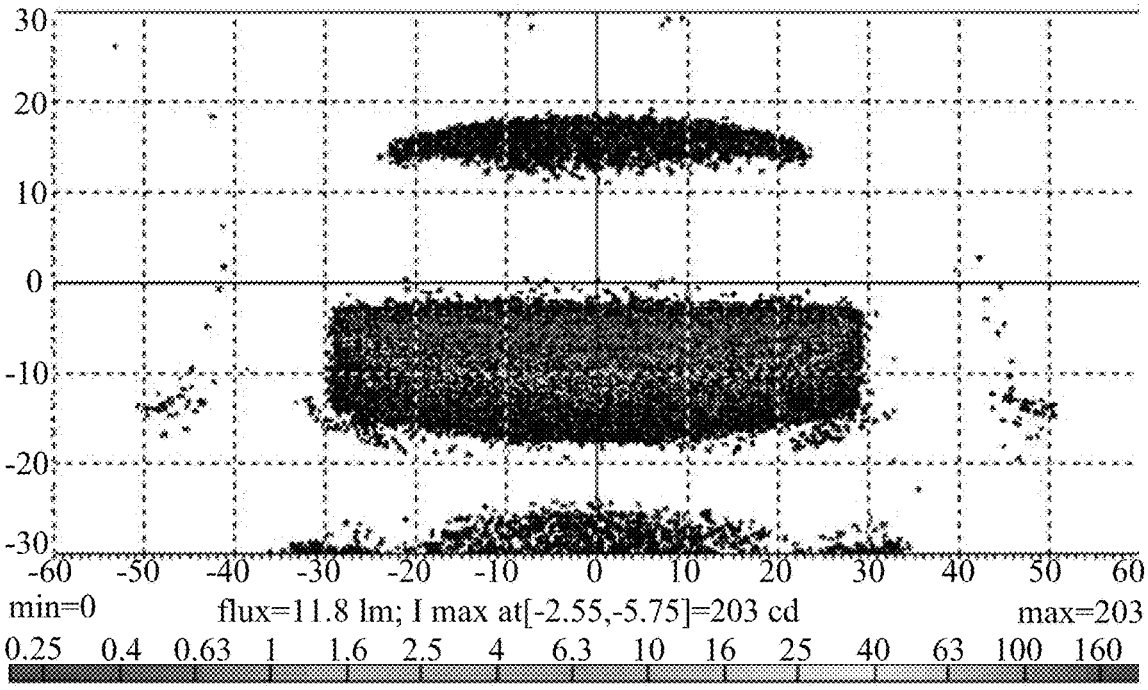
FIG. 13 is a stimulated light distribution graph formed on a vertical surface by a bottom lens of the vehicle lens of the embodiment.
Figure 14:
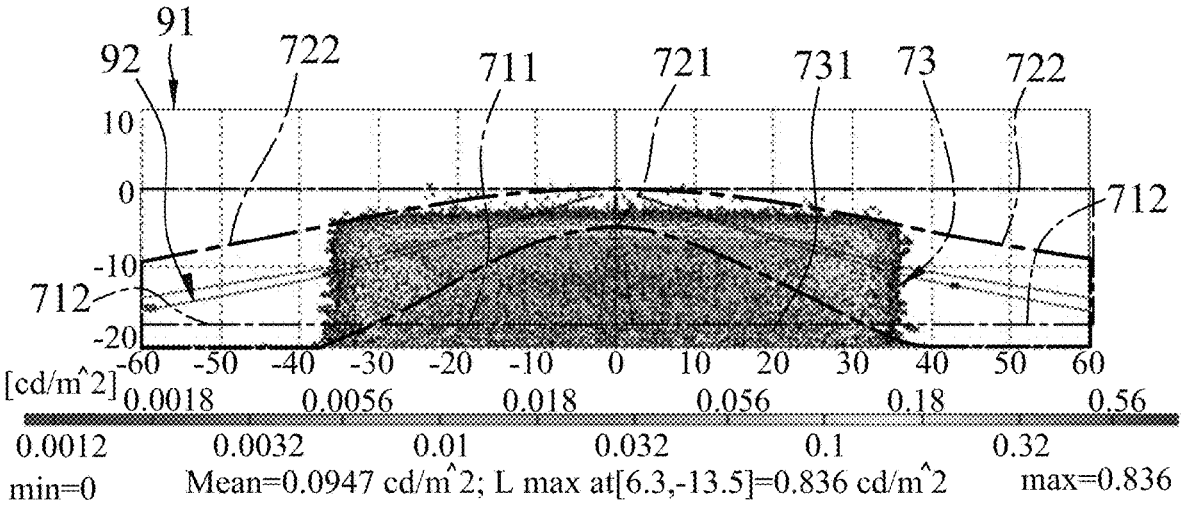
FIG. 14 is a stimulated light distribution graph formed on a horizontal surface by the bottom lens.

FIGS. 13 and 14 illustrate light patterns generated by the bottom lens 6. A phantom area defined by phantom lines in FIG. 14 schematically represents a region covered by the first light pattern 71 and the second light pattern 72.

As shown in FIG. 14, the bottom lens 6 projects from the light source 90 (see FIG. 5) a third light pattern 73 with a length extending in the left-right direction and a width extending in the rear-to-front direction. The third light pattern 73 includes a third light region 731 protruding rearwardly from the first light pattern 71. The third light region 731 is situated between the second lateral light regions 722.

Figure 15:
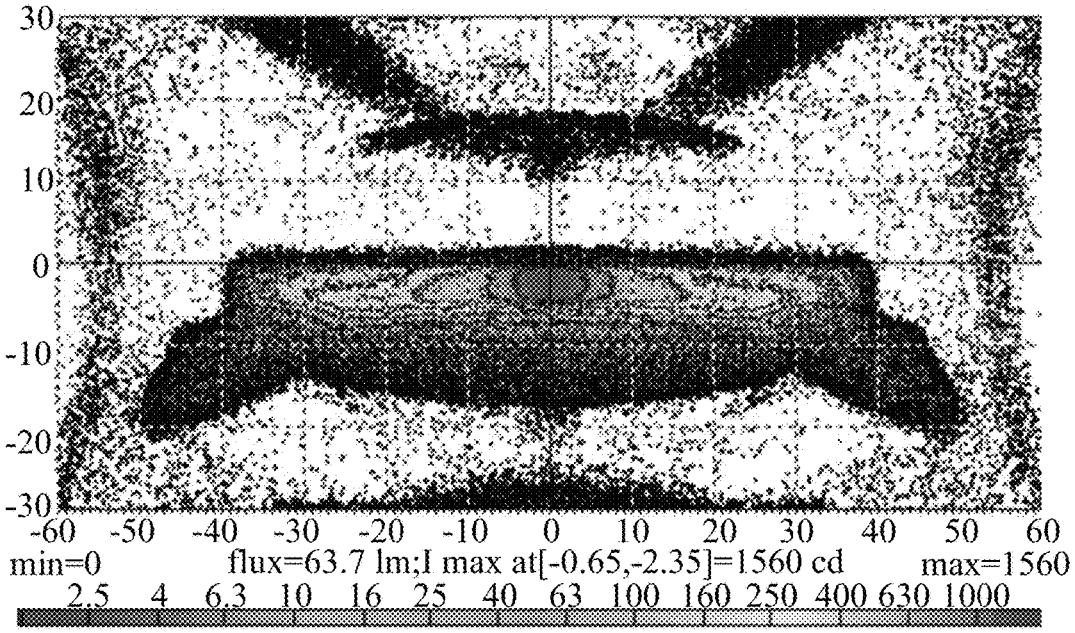
FIG. 15 is stimulated light distribution graph formed on a vertical surface by the vehicle lens apparatus of the embodiment.
Figure 16:
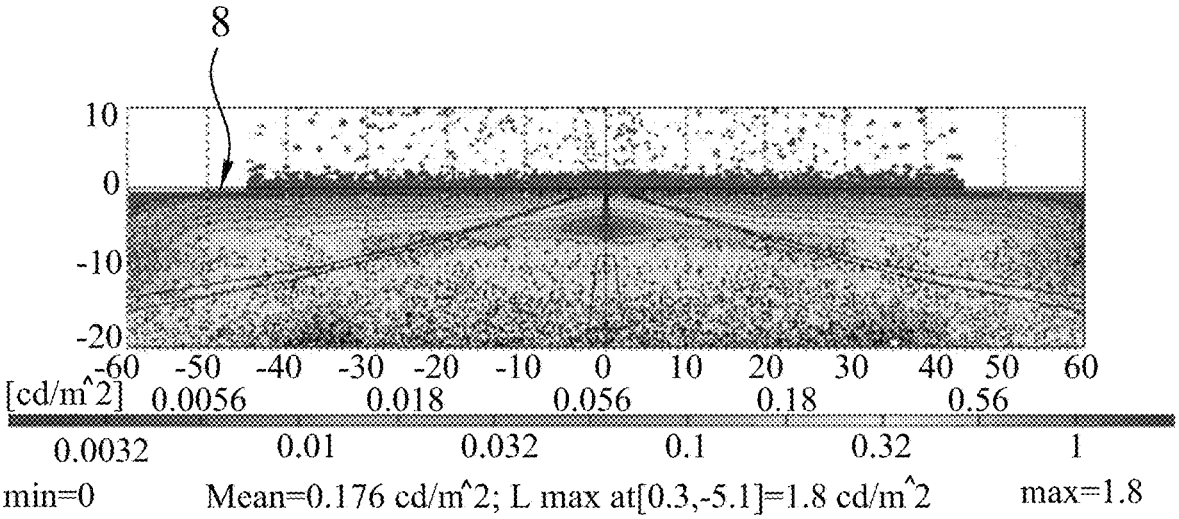
FIG. 16 is a stimulated light distribution graph formed on a horizontal surface by the vehicle lens apparatus of the embodiment.

FIGS. 15 and 16 illustrate light patterns generated by the lens units 3. As shown in FIG. 16, an overall light pattern 8 produced by the lens units 3 is composed of the first, second and third light patterns 71, 72, 73 of each lens unit 3. The second light pattern 72 produced by the top lens 5 of each lens unit 3 can eliminate the dark area or dead spot appearing in the light pattern of the prior art, so that the vehicle lens apparatus of the disclosure can enhance driving safety. By virtue of the third light pattern 73, the vehicle lens apparatus can provide more comprehensive light distribution.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A vehicle lens apparatus suitable for projecting light rays of a light source on a horizontal surface, comprising:

at least one lens unit including a main lens, and a top lens connected to a top end of said main lens;

said main lens including a main light exit face and a main light entry face formed rearwardly of said main light exit face, said main lens being configured to project in a rear-to-front direction from the light source onto the horizontal surface a first light pattern with a length extending in a left-right direction and a width extending in the rear-to-front direction, said first light pattern including a first main light region, and two first lateral light regions respectively formed at left and right sides of said first main light region; and said top lens being configured to project onto the horizontal surface a second light pattern that is convexed in the rear-to-front direction, said second light pattern including a second main light region superimposed on said first main light region, and two second lateral light regions extending respectively and rearwardly from left and right sides of said second main light region, said second lateral light regions protruding rearwardly and respectively from said first lateral light regions.

2. The vehicle lens apparatus as claimed in claim 1, wherein said top lens includes a top lens front face connected to an upper end of said main light exit face and configured for exiting light, and a top lens rear face disposed rearwardly of said top lens front face for reflecting light toward said top lens front face, a cross section of said top lens front face, which is formed along a horizontal cutting plane, having the shape of a convex curve that is convexed forwardly.

3. The vehicle lens apparatus as claimed in claim 1, wherein said top lens includes a top lens front face connected to an upper end of said main light exit face and a top lens rear face disposed rearwardly of said top lens front face, said top lens front face including a top lens upper edge distal from said main light exit face, said top lens upper edge being the form of a convex curve convexed forwardly.

4. The vehicle lens apparatus as claimed in claim 2, wherein said top lens further includes a top lens bottom face configured for entry of light and having a bottom face rear edge, said top lens bottom face being connected to an upper end of said main light entry face and extending rearwardly below said top lens rear face from said upper end of said main light entry face to said bottom face rear edge, said top lens rear face having a concave surface that is concaved downwardly toward said top lens bottom face.

5. The vehicle lens apparatus as claimed in claim 4, wherein said top lens rear face resembles a section of a truncated conical surface that is concaved downwardly toward said top lens bottom face.

6. The vehicle lens apparatus as claimed in claim 4, wherein said top lens rear face includes an upper curve edge having two spaced apart rear ends and being convexed forwardly from said rear ends, a lower curve edge having two spaced apart rear ends lower than said rear ends of said upper curve edge and convexed forwardly from said two spaced apart rear ends of said lower curve edge, a front side of said lower curve edge being situated behind and below a front side of said upper curve edge, and two rear edges extending upwardly, divergingly and respectively from said two spaced apart rear ends of said lower curve edge and connected respectively to said rear ends of said upper curve edge; and wherein said top lens rear face extends divergingly from said lower curve edge to said upper curve edge.

7. The vehicle lens apparatus as claimed in claim 6, wherein said bottom face rear edge has a notch, said lower curve edge being formed at said notch as a boundary of said notch, said two spaced apart rear ends of said lower curve edge meeting said bottom face rear edge.

8. The vehicle lens apparatus as claimed in claim 6, wherein said top lens further includes two end faces each of which is connected between one of said rear edges and said bottom face rear edge.

9. The vehicle lens apparatus as claimed in claim 1, wherein said at least one lens unit further includes a bottom lens connected to a bottom end of said main lens, said bottom lens being configured to project from the light source a third light pattern with a length extending in the left-right direction and a width extending in the rear-to-front direction, said third light pattern including a third light region protruding rearwardly from said first light pattern.

10. The vehicle lens apparatus as claimed in claim 9, wherein said bottom lens includes a bottom lens front face connected to a lower end of said main light exit face for exiting light, and a bottom lens rear face formed rearwardly of said bottom lens front face for reflecting light to said bottom lens front face, said bottom lens front face having a cross section formed along a horizontal cutting plane and resembling a convex curve that is convexed forwardly.

11. The vehicle lens apparatus as claimed in claim 10, wherein said bottom lens rear face has a cross section that is formed along a horizontal cutting plane and that resembles a concave curve concaved upwardly.

12. The vehicle lens apparatus as claimed in claim 1, wherein:

said at least one lens unit further includes a bottom lens connected to a bottom end of said main lens;

said bottom lens includes a bottom lens front face connected to a lower end of said main light exit face for exiting light, and a bottom lens rear face formed rearwardly of said bottom lens front face for reflecting light toward said bottom lens front face;

said bottom lens front face includes a bottom lens front edge distal from said lower end of said main light exit face of said main lens, said bottom lens front edge being the form of a convex curve convexed forwardly; and said bottom lens rear face has a bottom lens rear edge, said bottom lens rear face extending rearwardly and upwardly from said bottom lens front edge to said bottom lens rear edge, said bottom lens rear edge being the form of a concave curve concaved upwardly.

13. The vehicle lens apparatus as claimed in claim 1, wherein said at least one lens unit includes a plurality of lens units juxtaposed to each other in the left-right direction and integrally connected to each other, each of said lens units further including a bottom lens, said main lens integrally interconnecting said top lens and said bottom lens.

14. A vehicle lens apparatus, comprising:

at least one lens unit including a main lens, and a top lens connected to a top end of said main lens;

said main lens including a main light exit face and a main light entry face formed rearwardly of said main light exit face; and said top lens having a top lens front face connected to an upper end of said main light exit face for exiting light, a top lens rear face formed rearwardly of said top lens front face for reflecting light toward said top lens front face, and a top lens bottom face for entry of light, said top lens bottom face being connected to an upper end of said main light entry face, having a bottom face rear edge, and extending rearwardly below said top lens rear face from said upper end of said main light entry face to said bottom face rear edge, said top lens rear face being concaved downwardly toward said top lens bottom face.

15. The vehicle lens apparatus as claimed in claim 14, wherein a cross section of said top lens front face, which is formed along a horizontal cutting plane, has the shape of a convex curve that is convexed forwardly, said top lens rear face resembling a section of a truncated conical surface that is concaved downwardly toward said top lens bottom face.

16. The vehicle lens apparatus as claimed in claim 14, wherein said top lens rear face includes an upper curve edge having two spaced apart rear ends and convexed forwardly from said rear ends, a lower curve edge having two spaced apart rear ends that is lower than said rear ends of said upper curve edge and convexed forwardly from said two spaced apart rear ends of said lower curve edge, a front side of said lower curve edge being situated behind and below a front side of said upper curve edge, and two rear edges extending upwardly, divergingly and respectively from said two spaced apart rear ends of said lower curve edge and connected respectively to said rear ends of said upper curve edge; and wherein said top lens rear face extends divergingly and upwardly from said lower curve edge to said upper curve edge.

17. The vehicle lens apparatus as claimed in claim 16, wherein said bottom face rear edge has a notch, said lower curve edge being formed at said notch as a boundary edge of said notch, said two spaced apart rear ends of said lower curve edge meeting said bottom face rear edge.

18. The vehicle lens apparatus as claimed in claim 16, wherein said at least one lens unit further includes a bottom lens connected to a bottom end of said main lens, said bottom lens having a bottom lens front face connected to a lower end of said main light exit face for exiting light, a bottom lens rear face formed rearwardly of said bottom lens front face for reflecting light toward said bottom lens front face, and a bottom lens top face for entry of light, said bottom lens top face 63 being connected to a lower end of said main light entry face and extending rearwardly above said bottom lens rear face, said bottom lens rear face being concaved upwardly toward said bottom lens top face.

19. The vehicle lens apparatus as claimed in claim 18, wherein said bottom lens front face has a bottom lens front edge distal from said lower end of said main light exit face, said bottom lens front edge being the form of a convex curve convexed forwardly; and wherein said bottom lens rear face has a bottom lens rear edge connected to a rear end of said bottom lens top face, said bottom lens rear face extending rearwardly and upwardly from said bottom lens front edge to said bottom lens rear edge, said bottom lens rear edge being the form of a concave curve concaved upwardly.

* * * * *